US006510790B1

(12) United States Patent
Brückl et al.

(10) Patent No.: US 6,510,790 B1
(45) Date of Patent: Jan. 28, 2003

(54) DEVICE FOR DRAWING A WEB INTO A PRINTING PRESS

(75) Inventors: Thomas Rainer Brückl, Hettstadt (DE); Erwin Paul Josef Lehrieder, Gaukönigshofen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/744,980

(22) PCT Filed: Aug. 12, 1999

(86) PCT No.: PCT/DE99/02527

§ 371 (c)(1),
(2), (4) Date: Feb. 16, 2001

(87) PCT Pub. No.: WO00/10808

PCT Pub. Date: Mar. 2, 2000

(30) Foreign Application Priority Data

Aug. 18, 1998 (DE) ..... 198 37 361

(51) Int. Cl.[7] ..... B41F 13/03; B65H 20/00
(52) U.S. Cl. ..... 101/228; 226/92
(58) Field of Search ..... 101/181, 219, 101/224, 225, 227, 228; 226/91, 92; 242/332, 332.4, 532.7, 562.1

(56) References Cited

U.S. PATENT DOCUMENTS

| | | | | | |
|---|---|---|---|---|---|
| 4,063,505 | A | | 12/1977 | Sasamoto et al. | 101/228 |
| 4,693,405 | A | * | 9/1987 | Masse | 162/283 |
| 4,706,862 | A | | 11/1987 | Theilacker | 101/228 |
| 5,255,602 | A | | 10/1993 | Mamberer et al. | 101/228 |
| 6,223,962 | B1 | * | 5/2001 | Pimpis | 226/92 |
| 2001/0025577 | A1 | * | 10/2001 | Cousin et al. | 101/228 |

FOREIGN PATENT DOCUMENTS

| | | | |
|---|---|---|---|
| DE | 3309121 | C1 | 8/1984 |
| DE | 29710607 | U1 | 2/1998 |
| DE | 19816510 | A1 | 7/1999 |
| EP | 0533042 | A1 | 3/1993 |
| GB | 2256854 | A | 12/1992 |
| GB | 2315062 | A | 1/1998 |

* cited by examiner

*Primary Examiner*—Leslie J. Evanisko
(74) *Attorney, Agent, or Firm*—Jones Tullar & Cooper, PC

(57) ABSTRACT

A material web to be printed is drawn into a rotary printing press by securing a reinforcement element to a leading end of the material web. The reinforcement element can be enwrapped in the material web or held to the web by suitable catches. An openable and closable loop is formed in the reinforcement element and is used to connect the element to the web draw-in device of the printing press.

6 Claims, 3 Drawing Sheets

DEVICE FOR DRAWING A WEB INTO A PRINTING PRESS

FIELD OF THE INVENTION

The present invention relates to a device for drawing in a printing material web into a rotary printing press. One end of the printing material web can be connected to a draw-in element by using at least one reinforcement element.

A device for drawing in a printing material web is known from DE 297 10 607 U1. In this device, a wedge-shaped reinforced element is used for forming a draw-in tip.

U.S. Pat. No. 4,063,505 describes a device for drawing in a web of material by means of two tapes. A start of the web of material is maintained in a frictionally connected manner between the two tapes.

GB 2 256 854 A discloses a device for drawing in a printing material web by means of a reinforcement element. Here, the reinforcement element and the printing material web are connected by means of staples.

Later published DE 198 16 510 A1 discloses a draw-in tip, which is wrapped by the corners of the start of a web.

SUMMARY OF THE INVENTION

The object of the present invention is directed to creating devices and a method for the drawing in a printing material web.

In accordance with the present invention, this object is attained by a device and method in which one end of the printing material web which is to be drawn into a rotary printing press can be connected to a draw-in element by using at least one reinforcement element. This reinforcement element has catches on its side facing the web, or has a closable loop. The end of the printing material web and the reinforcing element are connected by the catches or by the loop.

A simply produced draw-in tip with a small number of adhesives is achieved, in an advantageous manner, by the device in accordance with the present invention. Only a small portion of the tractive forces is transmitted by the adhesives. An interlocking connection occurs between the reinforcement element and the free end of the material to be imprinted.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figures 1, 2:
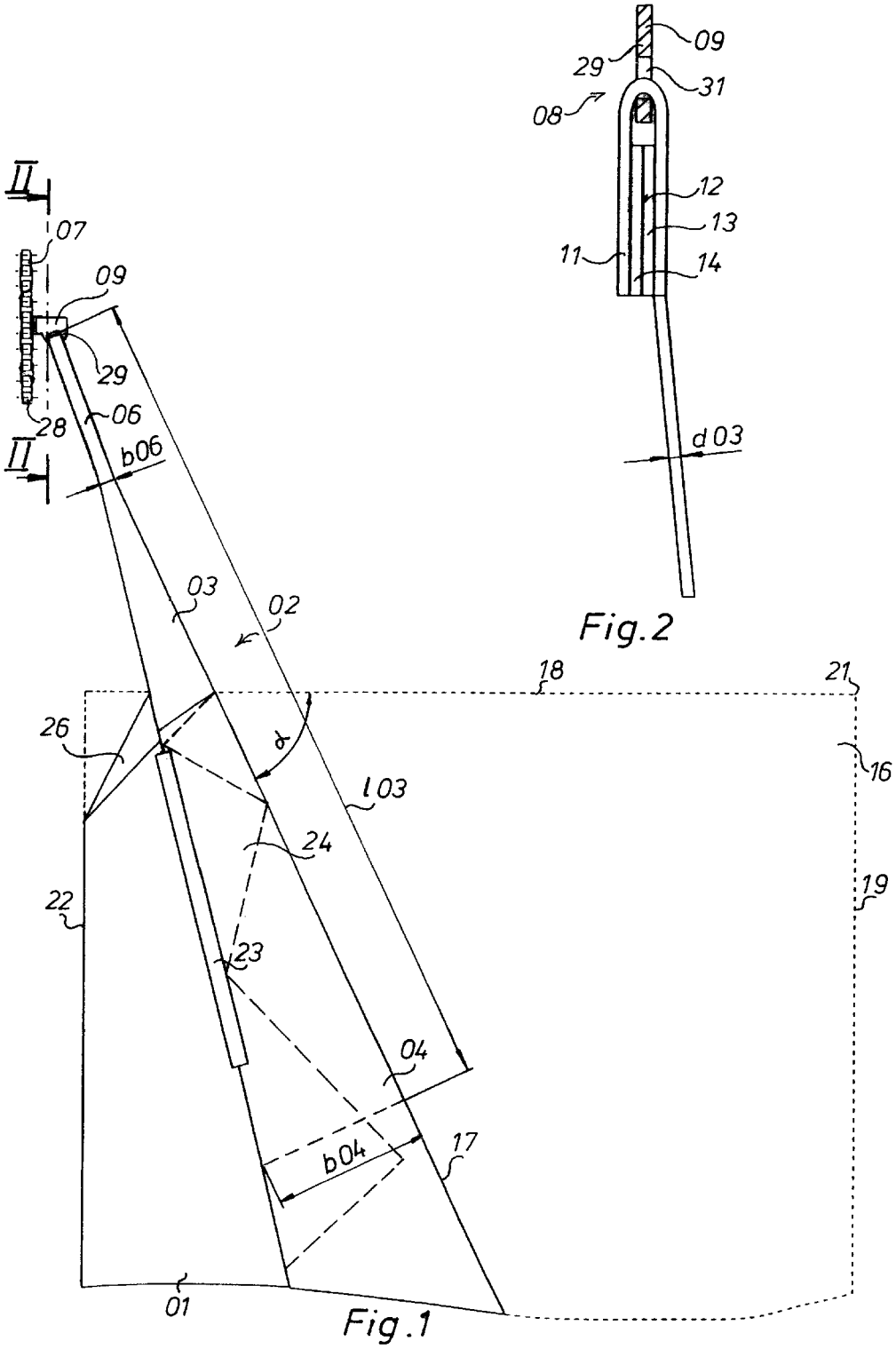
FIG. 1, a schematic representation of a device for drawing in a printing material web in accordance with a first preferred embodiment of the present invention, FIG. 2, an enlarged section in accordance with FIG. 1 in the area of the draw-in means, FIG. 3, the schematic representation of a device for drawing in a printing material web in accordance with a second preferred embodiment, FIG. 4, an enlarged portion in accordance with FIG. 3 in the area of the draw-in means, FIG. 5, a schematic representation of a device for drawing in a printing material web in accordance with a third preferred embodiment, and in FIG. 6, a schematic section in accordance with claim 5 in the area of an engagement element.

The start of a printing material web 01, for example a paper web, is provided with a draw-in tip 02 for drawing this printing material web 01 along a prepared guide path into a web-fed rotary printing press, for example. This draw-in tip 02 has a reinforcement element 03. In the present preferred embodiment, this reinforcement element 03 is embodied as a generally wedge-shaped plate having a thickness d03 of, for example 1 mm and having a length 103 along its linear edge 17 of, for example 1.5 m, all as seen in FIGS. 1 and 2. This reinforcement element 03 can be deformed, for example vertically reversible in respect to the conveying plane, and is made using a rubber-elastic material. The reinforcement element 03 preferably is made, for example, of a foil-like plastic material, such as, for example PA, PE, PVC, PTFE.

T-shaped or L-shaped reinforcement elements can also be used in place of a generally wedge-shaped reinforcement element 03. All of the contemplated shapes of the reinforcement element 03 have in common that a first, or attachment end 04 of a first width bO4, for example of 150 mm, is greater in comparison with a second or coupling end 06, having a second width bO6 of, for example 50 mm, of the reinforcement element 03.

The second or coupling end 06 of the reinforcement element 03 is provided with a coupling device for the selective fastening of the reinforcement element 03 to a draw-in element 07 of, for example, a web-fed rotary printing press.

This coupling device can be designed, for example, as a coupling loop 08, or as a coupling eye, which is able to be fastened to a catch 09 of the draw-in element 07.

In the present first preferred embodiment, the coupling loop 08 is formed by turning over or doubling back the second, free coupling end 06 of the reinforcement element 03. A turned-over or doubled back portion 11 of the second, free coupling end 06 of the reinforcement element 03 is again connected with the reinforcement element 03. This connection can be made by means of a hook-and-eye strip 12, as depicted in FIG. 2. In this case, in its stretched state the second, free coupling end 06 has on one side both of the partial elements; i.e.the hook strip 13 and eye strip 14 of the hook-and-eye strip 12, which partial elements 13 and 14 are arranged at a distance from each other. After turning the end 06 over, thus doubling it back on itself, the hook strip 13 is connected with the eye strip 14. In this way, a loop 08 is formed, which loop 08 can then be selectively opened and closed.

The opening and closing of the loop 08 can take place multiple times without destroying the material of the reinforcement element 03 in the process.

A magnetically acting connection, such as two magnets acting together, or one magnet acting together with a metal piece, or a snap fastener connection can be provided in place of a hook-and-eye strip 12 for forming such a loop 08, which magnetically acting connection or snap fastener connection is selectively opened and closed.

To form the draw-in tip 02, the reinforcement element 03, together with a front edge 18 of the free end 16 of the printing material web 01 extending transversely in respect to the conveying direction, forms an opening angle a in the range between 45° to 85°. A corner 21 of the printing material web 01, defined by the lateral edge 19 facing away from the front edge 18 and remote from the draw-in element 07, is temporarily held manually on the reinforcement element 03 or is connected with the reinforcement element 03 by means of an adhesive strip or an insertable tongue.

Starting at this remote corner 21, the reinforcement element 03 is turned over several times, so that the printing material web 01 is wrapped at least once completely around the reinforcement element 03. The free end 16 of the printing material web 01 is preferably wrapped around the reinforcement element 03 in several layers. In the course of this enwrapment, the reinforcement element 03 travels or moves laterally across the web 01 from the remote lateral edge 19 of the printing material web 01, which faces away from the draw-in element 07, to the proximal lateral edge 22 of the printing material web 01, which is close to the draw-in element 07.

The reinforcement element 03 turned-over or enwrapped in web 01 in this way is joined together with web 01, for example by means of an adhesive strip 23, so that the layers 24 of the printing material web 01 which surround reinforcement element 03 are connected with the free end 16 of the printing material web 01.

A proximal corner 26 of the free end 16 of the printing material web 01, which faces or is proximal to the draw-in element 07, can be folded in, to now be facing away from the draw-in element 07, and can also be secured on the free end 16 of the material web 01 by means of the adhesive strip 23, all as seen in FIG. 1.

The draw-in tip 02 formed in this way is now connected with the draw-in element 07.

This draw-in element 07 can be embodied, for example, as a chain 28 as depicted in FIG. 1, and has catch 09, embodied as a suspension clip 29, which extends out from chain 28 in the axial direction, i.e. perpendicularly in relation to the conveying direction T. An opening 31 or a hook for fastening the draw-in tip 02 is provided in this suspension clip 29.

Figure 4:
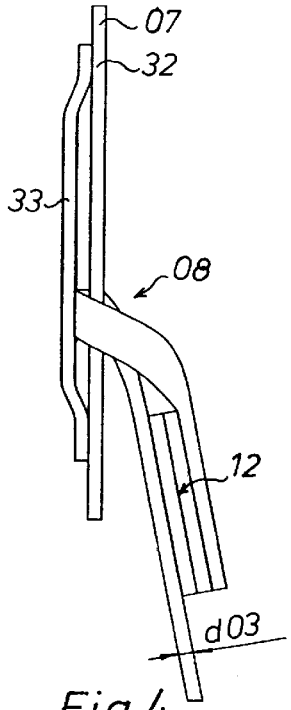
Figure 3:
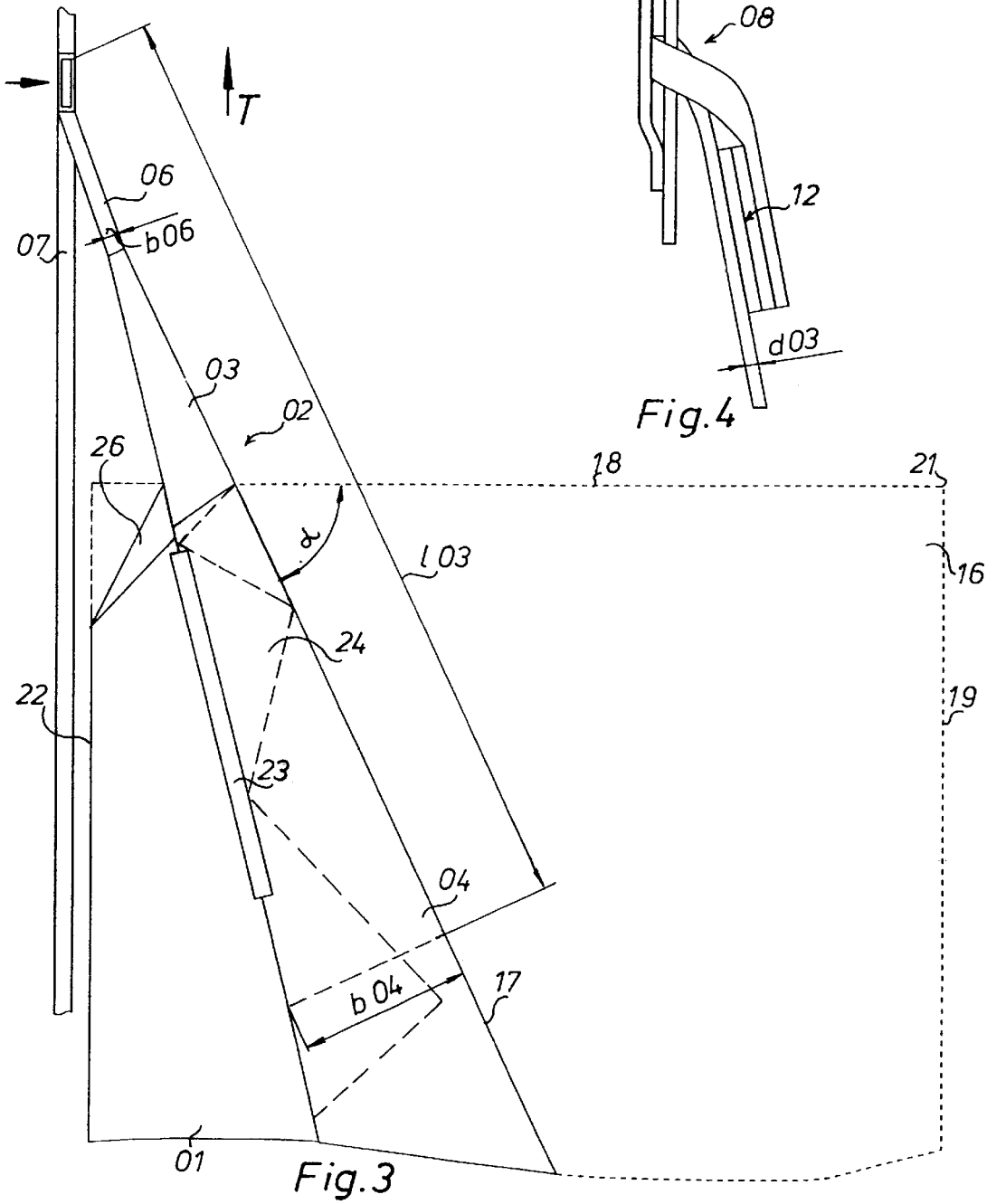

The draw-in element 07 can also be embodied as a tape 32, as shown in FIG. 3 and in FIG. 4, for example, on which loops 33, or in which slits are arranged.

Now the second, free or coupling end 06 of the draw-in tip 02 can be threaded through the opening 31 or the loop 33 of the draw-in means 28, 32, respectfully. This second, free or coupling end 06, once passed through the opening 31, 33 of the draw-in means 28, 32, is now turned over in the direction toward the draw-in tip 02 and is joined or doubled back on itself by means of the hook-and-eye strip 12 to form the coupling loop 08.

Figures 5, 6:
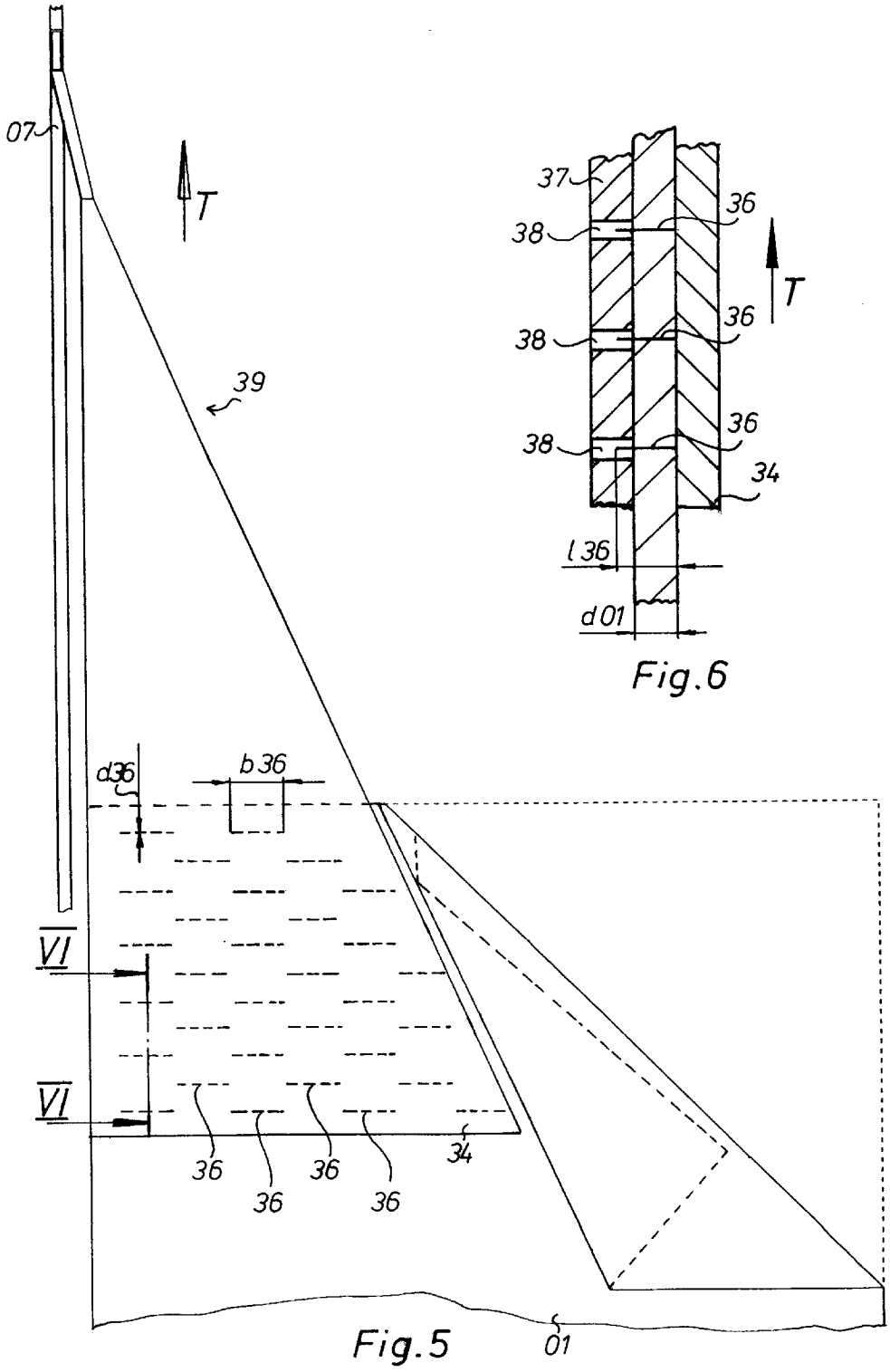

In a further preferred embodiment as seen in FIG. 5 and in FIG. 6, catches 36, which penetrate through the printing material web 01, are attached to a first side of a reinforcement element 34 facing the printing material web 01. The catches 36 are of a length 136 which is of at least the maximal thickness d01 of a printing material web 01 to be drawn in, a thickness d36, of for example 0.1 mm, extending in the conveying direction T, and a width b36, for example 10 mm, extending perpendicularly in respect to the conveying direction, as seen in FIGS. 5 and 6.

A counter element, acting as a female element 37, is associated with this reinforcement element 34, which acts as a male element 34 and which is provided with the previously discussed catches 36. This female element 37 has openings 38 matched to the catches 36. To form a draw-in tip 39, the free end 16 of the printing material web 01, for example, is placed on the female element 37, and the printing material web 01 is penetrated by means of the catches 36 of the male element 34. Now the female element 37 and the male element 34 are releasably connected with each other, for example magnetically, or by means of snap closures or by means of a hook-and-eye strip.

While preferred embodiments of a device for inserting a strip of fabric to be printed or for drawing in the strip of fabric or the printing material web into a rotary printing press, in accordance with the present invention have been set forth fully and completely hereinabove, it will apparent to one of skill in the art that a number of changes in, for example the specific rotary printing press, the drive for the draw-in device and the like could be made without departing from the true spirit and scope of the present invention which is accordingly to be limited only by the following claims.

What is claimed is:

1. A device for drawing a printing material web into a rotary printing press comprising:

a reinforcement element adapted to be secured to an end of the printing material web, said reinforcement element being engageable with a draw-in element of the rotary printing press;

a loop formed in an end of said reinforcement element, said loop being engageable with the draw-in element; and means to selectively open and close said loop.

2. The device of claim 1 wherein said means to selectively open and close said loop includes a hook and eye tape.

3. A draw-in tip adapted to connect a printing material web to a draw-in element of a rotary printing press, said draw-in tip comprising:

a reinforcement element;

an attachment end of said reinforcement element, said attachment end being adapted to be enwrapped with the printing material web adjacent a front edge of the printing material web, said attachment end being adapted to form an interlocking connection between said reinforcement element and the printing material web; and a coupling end of said reinforcement element, said coupling end having a coupling device selectively fastenable to the draw-in element, said coupling device being a coupling loop, said coupling loop being selectively opened and closed.

4. The draw-in tip of claim 3 wherein said coupling loop is defined by a double back portion of said coupling end.

5. The draw-in tip of claim 4 wherein said double back portion of said coupling end further includes means to selectively open and close said loop.

6. The draw-in tip of claim 3 wherein said attachment end is generally wedge-shaped.

* * * * *